US010460708B2

(12) United States Patent
Love

(10) Patent No.: US 10,460,708 B2
(45) Date of Patent: Oct. 29, 2019

(54) FREQUENCY CONTROL CYMBAL

(71) Applicant: SABIAN LTD., Meductic (CA)

(72) Inventor: Mark Love, Hay Settlement (CA)

(73) Assignee: Sabian Ltd., Meductic (CA)

( * ) Notice: Subject to any disclaimer, the term of this patent is extended or adjusted under 35 U.S.C. 154(b) by 0 days.

(21) Appl. No.: 15/875,843

(22) Filed: Jan. 19, 2018

(65) Prior Publication Data

US 2019/0228750 A1 Jul. 25, 2019

(51) Int. Cl.
*G10D 13/06* (2006.01)

(52) U.S. Cl.
CPC ..... *G10D 13/06* (2013.01)

(58) Field of Classification Search
None
See application file for complete search history.

(56) References Cited

U.S. PATENT DOCUMENTS

D301,893 S * 6/1989 Hargrove ..... 84/402
D526,001 S * 8/2006 Scharte ..... D17/22
D597,589 S * 8/2009 Onishi ..... D17/22
7,626,106 B2 * 12/2009 Stannard ..... G10D 13/06 84/402
D607,921 S * 1/2010 Onishi ..... D17/22
7,750,218 B2 * 7/2010 Stannard ..... G10D 13/06 84/402
7,943,841 B2 * 5/2011 Toda ..... G10H 1/348 84/104
7,952,009 B2 * 5/2011 Stannard ..... G10D 13/06 84/402
8,497,418 B2 * 7/2013 Roderick ..... G10H 3/143 84/464 A
D688,737 S * 8/2013 Tatsumi ..... D17/22
D692,943 S * 11/2013 Tatsumi ..... D17/22
9,990,909 B1 * 6/2018 Azaceta ..... G10D 13/06
2007/0131090 A1 * 6/2007 Stannard ..... G10D 13/06 84/422.4
2008/0105104 A1 * 5/2008 Stannard ..... G10D 13/06 84/402
2015/0269921 A1 * 9/2015 Truchsess ..... G10D 13/06 84/422.1

FOREIGN PATENT DOCUMENTS

DE 399870 C * 8/1924 ..... G10D 13/06
JP 11184459 A * 7/1999 ..... G10D 13/029

* cited by examiner

*Primary Examiner* — Robert W Horn
(74) *Attorney, Agent, or Firm* — Kramer Amado P.C.

(57) ABSTRACT

A cymbal is disclosed that reduces the presence of high partials and some midrange frequencies from a vibrating cymbal, without noticeable changes of volume, sustain and free movement of the cymbal. This design reduces the amplitude of the cymbal at high frequencies and a specific midrange, while leaving other frequencies relatively unchanged. The cymbal may be played in a normal manner by the drummer, reducing unwanted changes in rhythm. The invention teaches the introduction of rings of apertures around the central mounting hole. The apertures are approximately ⅛" or 3.175 mm in diameter, and are evenly spaced around the ring. The location of these rings (measured from the center of the mounting hole) and the number of apertures in each ring is specified.

14 Claims, 10 Drawing Sheets

REDUCTION RANGES

400 Hz – 800 Hz 3.15 kHz – 5 kHz 8 kHz – 16 kHz

FREQUENCY RESPONSE COMPARISON

FREQUENCY CONTROL CYMBAL

FIELD OF THE INVENTION

The invention described herein relates to cymbals that are designed to reduce frequencies in a high frequency range and a middle frequency range while leaving other frequencies relatively unchanged. This results in a cymbal that is particularly useful for live performance in venues that were not designed specifically for the playing of live music.

BACKGROUND OF THE INVENTION

A cymbal is a percussion instrument from the idiophone classification that produces sound by being shaken, struck or rubbed. When a cymbal is vibrating, many frequencies of sound are produced, which in aggregate comprise the timbre of a cymbal. The high frequencies of a cymbal are most prominent and are the partials that give a cymbal its projection and "presence," but there are instances when projection is undesirable. These instances may include but are not limited to live or recorded acoustic performances in venues that naturally amplify certain frequencies. Often, these are venues that were not designed specifically for the playing of live music. There is also a midrange of frequencies that are common frequencies for voices, where strong drum frequencies are undesirable.

Typical solutions to reduce projection would be to mechanically alter a cymbal by placing an external mute or other device on it, but the resulting sound would be reduced in all partials as well as overall volume and sustain that the cymbal would naturally produce. Because mechanical devices inhibit overall vibrations, the reaction of an implement, such as a drum stick, is affected which in turn causes the percussionist to alter how the implement is put into motion. These physical changes made by the percussionist to compensate for changes of the playing surface result in undesired changes in rhythm.

It is also known to reduce the volume of a cymbal by piercing holes or apertures through the cymbal. However, these solutions are designed to reduce the volume or amplitude across all frequencies.

SUMMARY OF THE INVENTION

The design in this application reduces the presence of high partials and some mid-range partials from a vibrating cymbal, without noticeable changes of volume, sustain and free movement of the cymbal. This design reduces the amplitude of the cymbal at high frequencies and some mid-range frequencies, while leaving other frequencies relatively unchanged. The cymbal may be played in a normal manner by the drummer, reducing unwanted changes in rhythm.

The invention teaches the introduction of rings of apertures around the central mounting hole. The apertures are approximately ⅛" or 3.175 mm in diameter, and are evenly spaced around the ring. The location of these rings (measured from the center of the mounting hole) and the number of apertures in each ring is specified. Most of these rings are aligned so the apertures form rows extending radially from the center of the mounting hole, although in some of the larger cymbals some of the outer rings are offset.

Offset refers to the angle formed by the intersection of a line extending radially from the center of the mounting hole through row of holes and a line drawn from an aperture in the offset ring and an aperture in the next closest non-offset ring. This is illustrated in FIG. 7, and discussed in the accompanying text, below.

The nearest ring to the center of the mounting hole is located a minimum of 45 mm from the center of the mounting hole. So as not to compromise the durability of the cymbal, the rings should be at least 7 mm apart. To maintain the reduction in high frequencies, the rings should be a maximum of 15 mm apart in the bow area nearest the bell.

In accordance with the present invention, there is provided a circular cymbal with a central mounting hole surrounded by a bell area surrounded by a bow area, and a plurality of approximately 3.175 mm diameter apertures pierced through the cymbal, where the plurality of apertures consists of at least one ring of evenly spaced apertures. In an aspect of this invention, the circular cymbal has the closest ring located to the central mounting hole is 45 mm from the central mounting hole, and each ring is at least 7 mm apart in the bell area and less than 15 mm apart in the bow area nearest the bell area.

In another aspect of this invention, the cymbal has an approximately 355 mm diameter and a central mounting hole and a plurality of 3.175 mm diameter apertures pierced through the cymbal, where the plurality of apertures is a ring of evenly spaced 32 apertures located 45 mm from the mounting hole.

In another aspect of this invention, cymbal has an approximately 355 mm diameter and a central mounting hole and a plurality of 3.175 mm diameter apertures pierced through the cymbal, where the plurality of apertures consists of seven rings of evenly spaced apertures, where five rings have 32 apertures in each ring and are located 45 mm, 52 mm, 59 mm, 66 mm, and 73 mm from the mounting hole, and two rings have 64 apertures in each ring and are located 80 mm and 87 mm from the mounting hole. In a feature of this aspect, none of the rings of apertures are offset.

In another aspect of this invention, the cymbal has an approximately 406 mm diameter and a central mounting hole and a plurality of 3.175 mm diameter apertures pierced through the cymbal, where the plurality of apertures consists of seven rings of evenly spaced apertures, where five rings have 32 apertures in each ring and are located 45 mm, 52 mm, 59 mm, 66 mm, and 73 mm from the mounting hole, and two rings have 64 apertures in each ring and are located 80 mm and 87 mm from the mounting hole. In a feature of this aspect, none of the rings of apertures are offset.

In another aspect of this invention, the cymbal has an approximately 432 mm diameter and a central mounting hole and a plurality of 3.175 mm diameter apertures pierced through the cymbal, where the plurality of apertures consists of eight rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole. In a feature of this aspect, none of the rings of apertures are offset.

In another aspect of this invention, the cymbal has an approximately 457 mm diameter and a central mounting hole and a plurality of 3.175 mm diameter apertures pierced through the cymbal, where the plurality of apertures consists of eight rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole. In a feature of this aspect, none of the rings of apertures are offset.

In another aspect of this invention, the cymbal has an approximately 482.6 mm diameter and a central mounting hole and a plurality of 3.175 mm diameter apertures pierced through the cymbal, where the plurality of apertures consists of eight rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole. In a feature of this aspect, none of the rings of apertures are offset.

In another aspect of this invention, the cymbal has an approximately 508 mm diameter and a central mounting hole and a plurality of 3.175 mm diameter apertures pierced through the cymbal, where the plurality of apertures consists of eleven rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole, three rings have 140 apertures in each ring and are located 210 mm, 217 mm and 224 mm from the mounting hole, and the ring located 217 mm from the mounting hole is offset by 40 degrees from the other rings.

In another aspect of this invention, the cymbal has an approximately 533 mm diameter and a central mounting hole and a plurality of 3.175 mm diameter apertures pierced through the cymbal, where the plurality of apertures consists of eleven rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole, three rings have 140 apertures in each ring and are located 217 mm, 224 mm and 231 mm from the mounting hole, and the ring located 224 mm from the mounting hole is offset by 40 degrees from the other rings.

BRIEF DESCRIPTION OF THE DRAWINGS

The invention is illustrated in the figures of the accompanying drawings which are meant to be exemplary and not limiting, in which like references are intended to refer to like or corresponding parts, and in which.

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. Those of skill in the art understand that other embodiments may be utilized and structural changes may be made without departing from the scope of the present invention. Likewise, a reasonably broad scope for claimed or covered subject matter is intended. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

The invention teaches the introduction of rings of apertures around the central mounting hole. The apertures are approximately ⅛" or 3.175 mm in diameter, and are evenly spaced around the ring. The location of these rings (measured from the center of the mounting hole) and the number of apertures in each ring is specified. Most of these rings are aligned so the apertures form rows extending radially from the center of the mounting hole, although in some of the larger cymbals some of the outer rings are offset.

The nearest ring to the center of the mounting hole is located a minimum of 45 mm from the center of the mounting hole. So as not to compromise the durability of the cymbal, the rings should be at least 7 mm apart. To maintain the reduction in high frequencies, the rings should be a maximum of 15 mm apart in the bow area nearest the bell.

Figure 1:
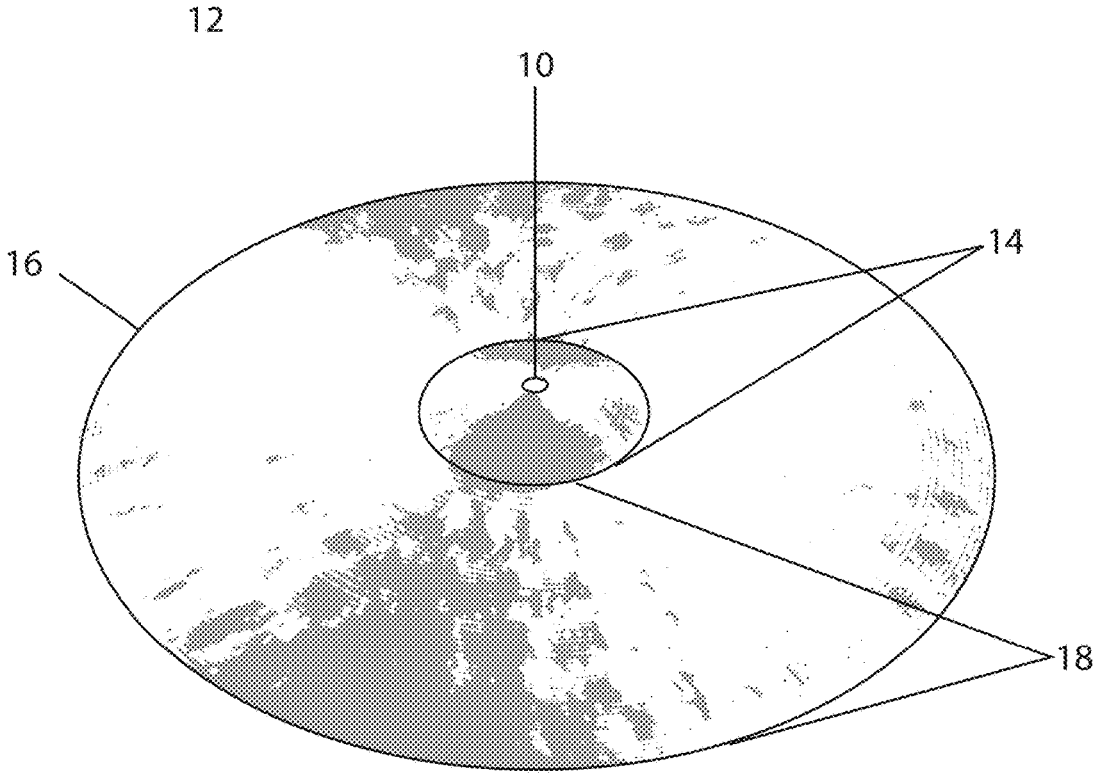
FIG. 1 is a perspective view of a typical cymbal.
Figure 2:
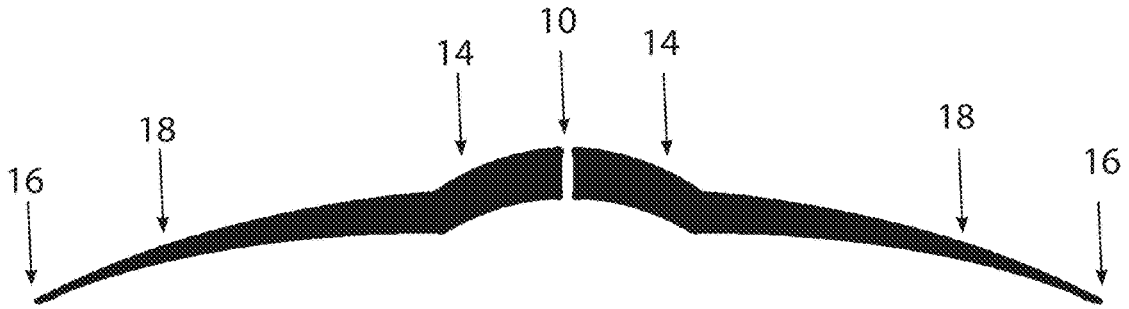
FIG. 2 is a side view of a typical cymbal.

A typical cymbal is illustrated in FIGS. 1 and 2, where FIG. 1 is a perspective view of the cymbal and FIG. 2 is a side view. Turning to FIGS. 1 and 2, there is a mounting hole 10 in the center of the cymbal 12. Surrounding the mounting hole 10 is a raised section called a bell 14. The cymbal has an edge 16. The area between the bell 14 and the edge 16 is the bow 18.

Rings of apertures or holes of ⅛" or 3.175 mm diameter are drilled or punched through the cymbal. (the apertures do not have to be drilled or punched, but can be created in any manner knows to person skilled in the art) The location and number of these apertures are selected to provide the reduction in high frequencies while maintaining the amplitude of other frequencies. The location and number of these apertures changes depending upon the size or diameter of the cymbal.

The location of the apertures in a 14 inch hi-hit top cymbal 30 is illustrated in FIG. 3*a*. The location of the apertures in this cymbal is specified in the following Table 1:

TABLE 1

| Pattern on a 355.00 mm diameter cymbal | | | |
|---|---|---|---|
| | Number of Holes | Radius | Offset |
| 1 | 32 | 45.00 mm | 0.00° |

Figure 3:
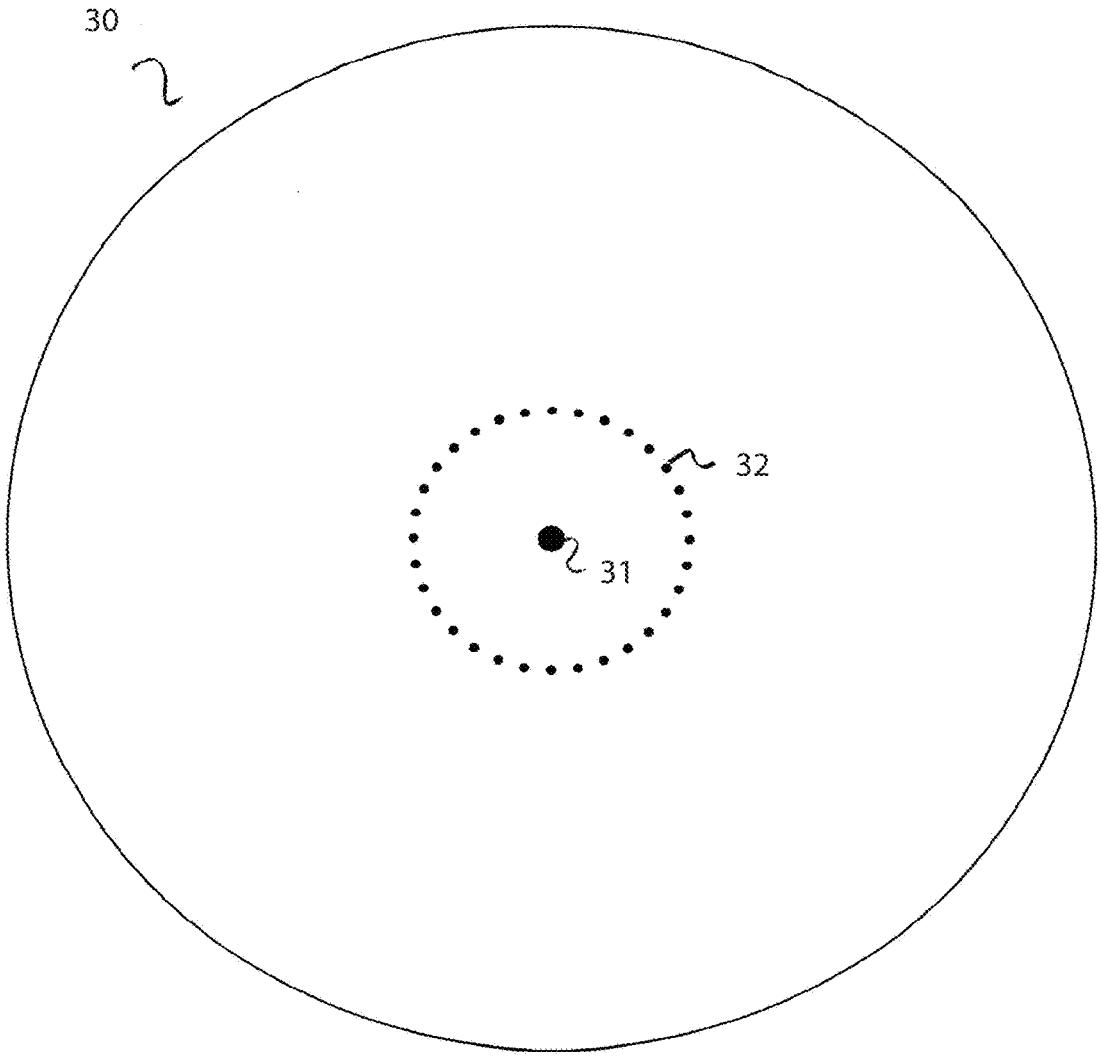
FIG. 3 is an illustration of the apertures on a 14 inch diameter hi hat cymbal.

From Table 1 and FIG. 3, it may be seen that cymbal 30 has one ring (labelled 32) of apertures (recall from above the apertures have a diameter of ⅛" or 3.175 mm) of 32 evenly spaced apertures, in a ring located 45 mm from the center of mounting hole 31. In one embodiment, the bell has a diameter of 3⅞" or 9.8425 cm, and the cymbal is approximately 0.042" thick in the bell and approximately 0.032 to 0.052" thick in the bow.

The location of the apertures in a 14 inch crash cymbal 35 is specified in the following Table 2:

TABLE 2

| Pattern on a 355.00 mm diameter cymbal | | | |
|---|---|---|---|
| | Number of Holes | Radius | Offset |
| 1 | 32 | 45.00 mm | 0.00° |
| 2 | 32 | 52.00 mm | 0.00° |
| 3 | 32 | 59.00 mm | 0.00° |
| 4 | 32 | 66.00 mm | 0.00° |
| 5 | 32 | 73.00 mm | 0.00° |
| 6 | 64 | 80.00 mm | 0.00° |
| 7 | 64 | 87.00 mm | 0.00° |

Figure 4:
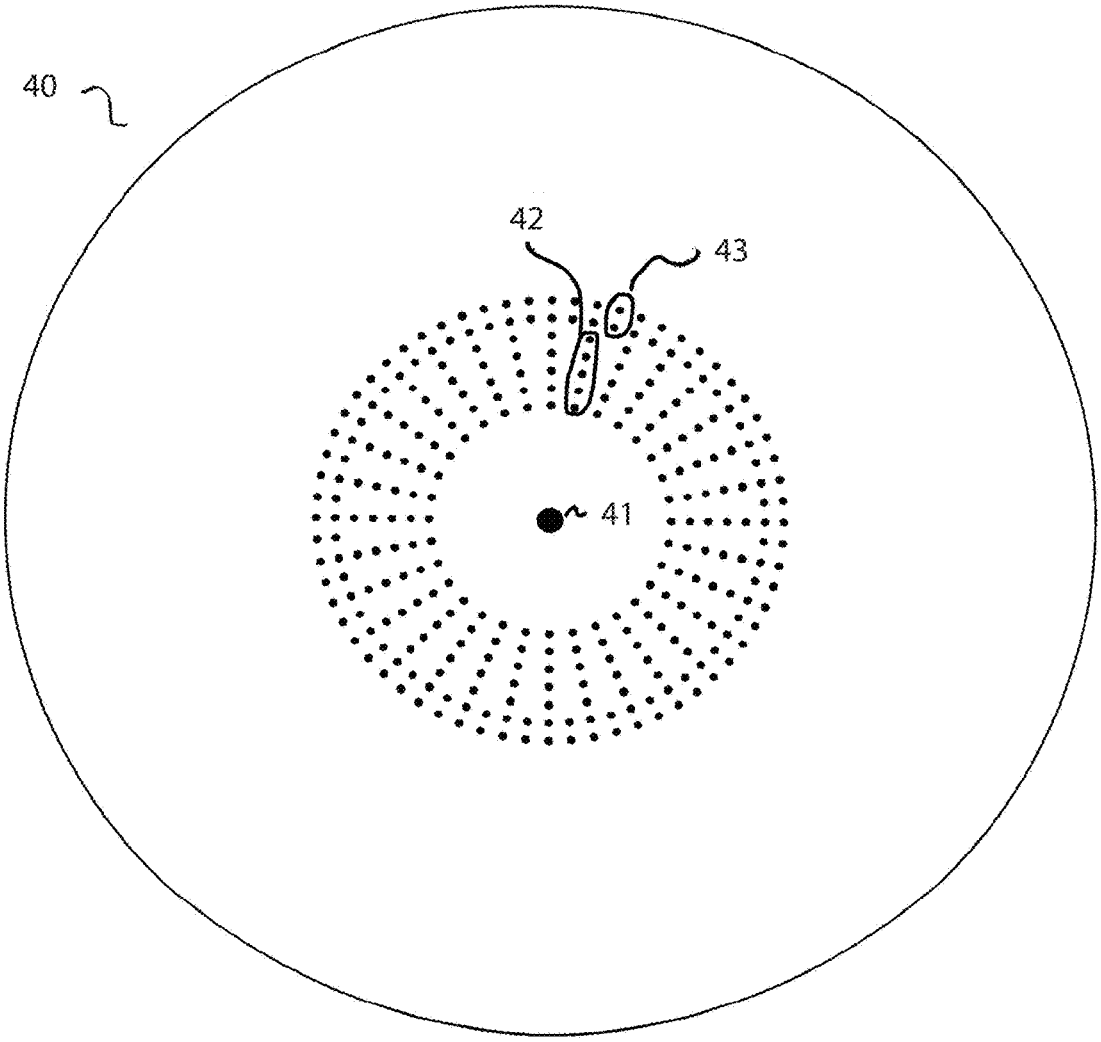
FIG. 4 is an illustration of the apertures on a 16 inch diameter cymbal.

From Table 2 and FIG. 4, it may be seen that this cymbal has seven rings of apertures (recall from above the apertures have a diameter of ⅛" or 3.175 mm), the first 5 rings having 32 evenly spaced apertures and the last two rings having 64 evenly spaced apertures, the seven rings are located 45, 52, 59, 66, 73, 80 and 87 mm from the center of mounting hole 41, and the rings are not offset.

The location of the apertures in a 16 inch cymbal 40 is illustrated in FIG. 4. The location of the apertures in this cymbal is specified in the following Table 3:

TABLE 3

| Pattern on a 406.00 mm diameter cymbal | | | |
|---|---|---|---|
| | Number of Holes | Radius | Offset |
| 1 | 32 | 45.00 mm | 0.00° |
| 2 | 32 | 52.00 mm | 0.00° |
| 3 | 32 | 59.00 mm | 0.00° |
| 4 | 32 | 66.00 mm | 0.00° |
| 5 | 32 | 73.00 mm | 0.00° |
| 6 | 64 | 80.00 mm | 0.00° |
| 7 | 64 | 87.00 mm | 0.00° |

From Table 3 and FIG. 4, it may be seen that cymbal 40 has seven rings of apertures (recall from above the apertures have a diameter of ⅛" or 3.175 mm), the first 5 rings (labelled 42) having 32 evenly spaced apertures and the last two rings (labelled 43) having 64 evenly spaced apertures, the seven rings are located 45, 52, 59, 66, 73, 80 and 87 mm from the center of mounting hole 41, and the rings are not offset. In one embodiment, the bell has a diameter of 5" or 12.7 cm, and the cymbal is approximately 0.036" thick in the bell and approximately 0.025 to 0.030" thick in the bow.

Figure 5:
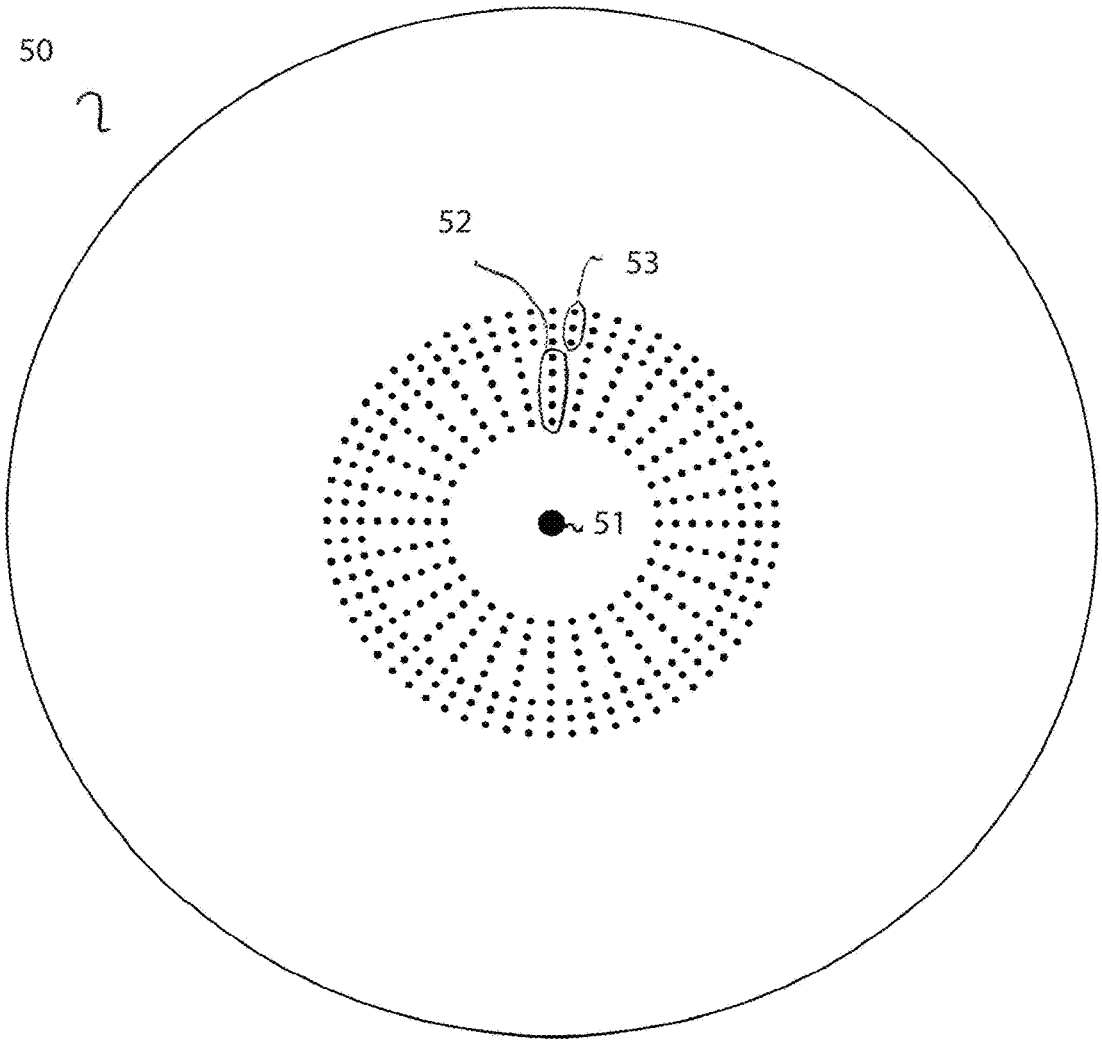
FIG. 5 is an illustration of the apertures on a 17 inch diameter cymbal.

The location of the apertures in a 17 inch cymbal 50 is illustrated in FIG. 5. The location of the apertures in this cymbal is specified in the following Table 4:

TABLE 4

| Pattern on a 432.00 mm diameter cymbal | | | |
|---|---|---|---|
| | Number of Holes | Radius | Offset |
| 1 | 32 | 45.00 mm | 0.00° |
| 2 | 32 | 52.00 mm | 0.00° |
| 3 | 32 | 59.00 mm | 0.00° |
| 4 | 32 | 66.00 mm | 0.00° |
| 5 | 32 | 73.00 mm | 0.00° |
| 6 | 64 | 80.00 mm | 0.00° |
| 7 | 64 | 87.00 mm | 0.00° |
| 8 | 64 | 94.00 mm | 0.00° |

From Table 4 and FIG. 5, it may be seen that cymbal 50 has eight rings of apertures (recall from above the apertures have a diameter of ⅛" or 1.375 mm), the first 5 rings (labelled 52) having 32 evenly spaced apertures and the last three rings (labelled 53) having 64 evenly spaced apertures, the eight rings are rings located 45, 52, 59, 66, 73, 80, 87 and 94 mm from the center of mounting hole 51, and the rings are not offset. In one embodiment, the bell has a diameter of 5" or 12.7 cm, and the cymbal is approximately 0.037" thick in the bell and approximately 0.028 to 0.033" thick in the bow.

Figure 6:
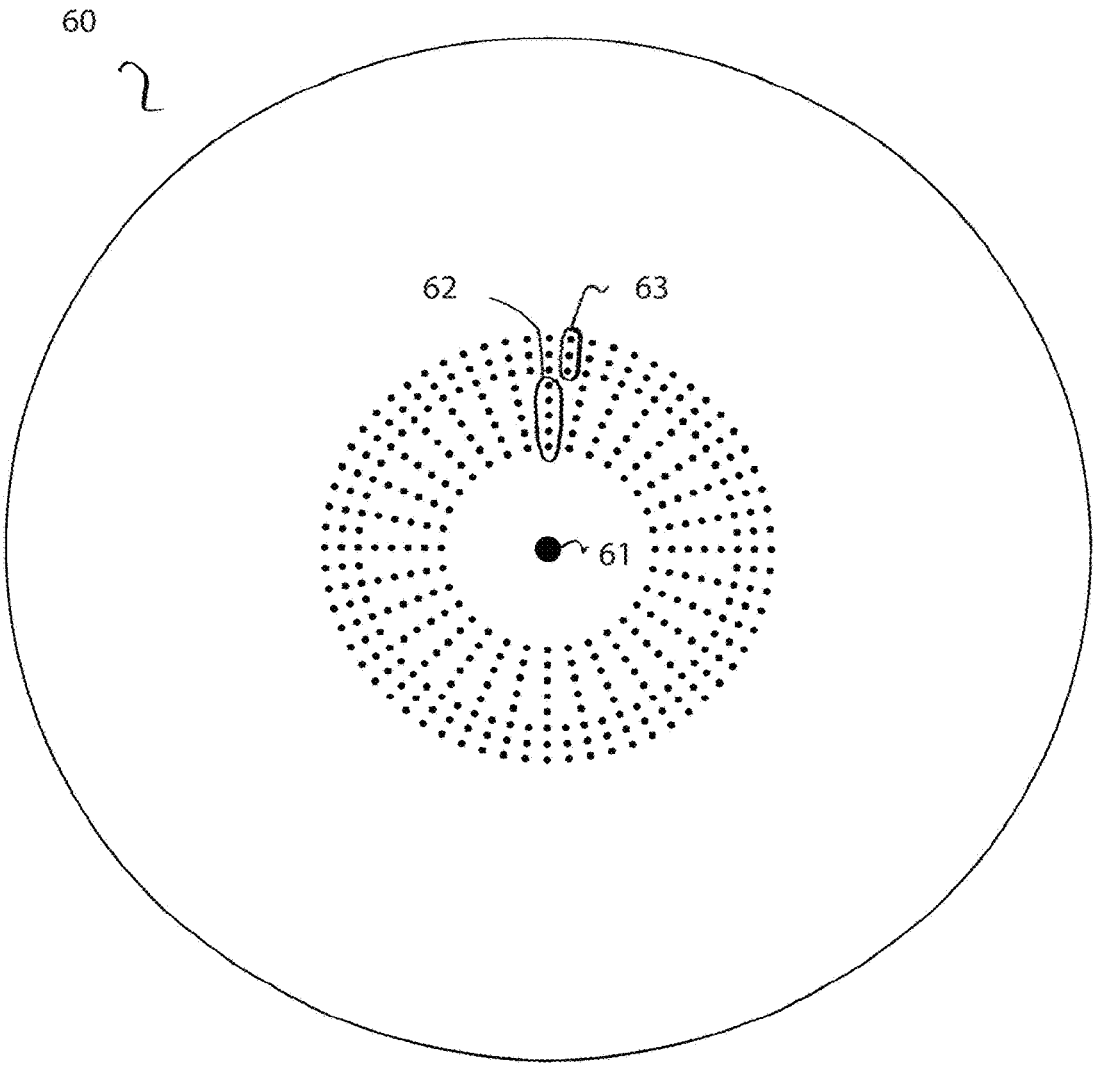
FIG. 6 is an illustration of the apertures on an 18 inch diameter cymbal.

The location of the apertures in an 18 inch cymbal 60 is illustrated in FIG. 6. The location of the apertures in this cymbal is specified in the following Table 5:

TABLE 5

| Pattern on a 457.00 mm diameter cymbal | | | |
|---|---|---|---|
| | Number of Holes | Radius | Offset |
| 1 | 32 | 45.00 mm | 0.00° |
| 2 | 32 | 52.00 mm | 0.00° |
| 3 | 32 | 59.00 mm | 0.00° |
| 4 | 32 | 66.00 mm | 0.00° |
| 5 | 32 | 73.00 mm | 0.00° |
| 6 | 64 | 80.00 mm | 0.00° |
| 7 | 64 | 87.00 mm | 0.00° |
| 8 | 64 | 94.00 mm | 0.00° |

From Table 5 and FIG. 6, it may be seen that cymbal 60 has eight rings of apertures (recall from above the apertures have a diameter of ⅛" or 3.175 mm), the first 5 rings (labelled 62) having 32 evenly spaced apertures and the last three rings (labelled 63) having 64 evenly spaced apertures, the eight rings are rings located 45, 52, 59, 66, 73, 80, 87 and 94 mm from center of the mounting hole 61, and the rings are not offset. In one embodiment, the bell has a diameter of 5¼" or 13.335 cm, and the cymbal is approximately 0.037" thick in the bell and approximately 0.030 to 0.036" thick in the bow.

The location of the apertures in a 19 inch cymbal is specified in the following Table 6:

TABLE 6

| Pattern on a 482.60 mm diameter cymbal | | | |
|---|---|---|---|
| | Number of Holes | Radius | Offset |
| 1 | 32 | 45.00 mm | 0.00° |
| 2 | 32 | 52.00 mm | 0.00° |
| 3 | 32 | 59.00 mm | 0.00° |
| 4 | 32 | 66.00 mm | 0.00° |
| 5 | 32 | 73.00 mm | 0.00° |
| 6 | 64 | 80.00 mm | 0.00° |

TABLE 6-continued

| Pattern on a 482.60 mm diameter cymbal | | | |
|---|---|---|---|
| | Number of Holes | Radius | Offset |
| 7 | 64 | 87.00 mm | 0.00° |
| 8 | 64 | 94.00 mm | 0.00° |

From Table 6, it may be seen that this cymbal has eight rings of apertures (recall from above the apertures have a diameter of ⅛" or 3.175 mm), the first 5 rings having 32 evenly spaced apertures and the last three rings having 64 evenly spaced apertures, the eight rings are rings located 45, 52, 59, 66, 73, 80, 87 and 94 mm from center of the mounting hole 61, and the rings are not offset. In one embodiment, the bell has a diameter of 5¼" or 13.335 cm, and the cymbal is approximately 0.037" thick in the bell and approximately 0.030 to 0.036" thick in the bow.

Figure 7:
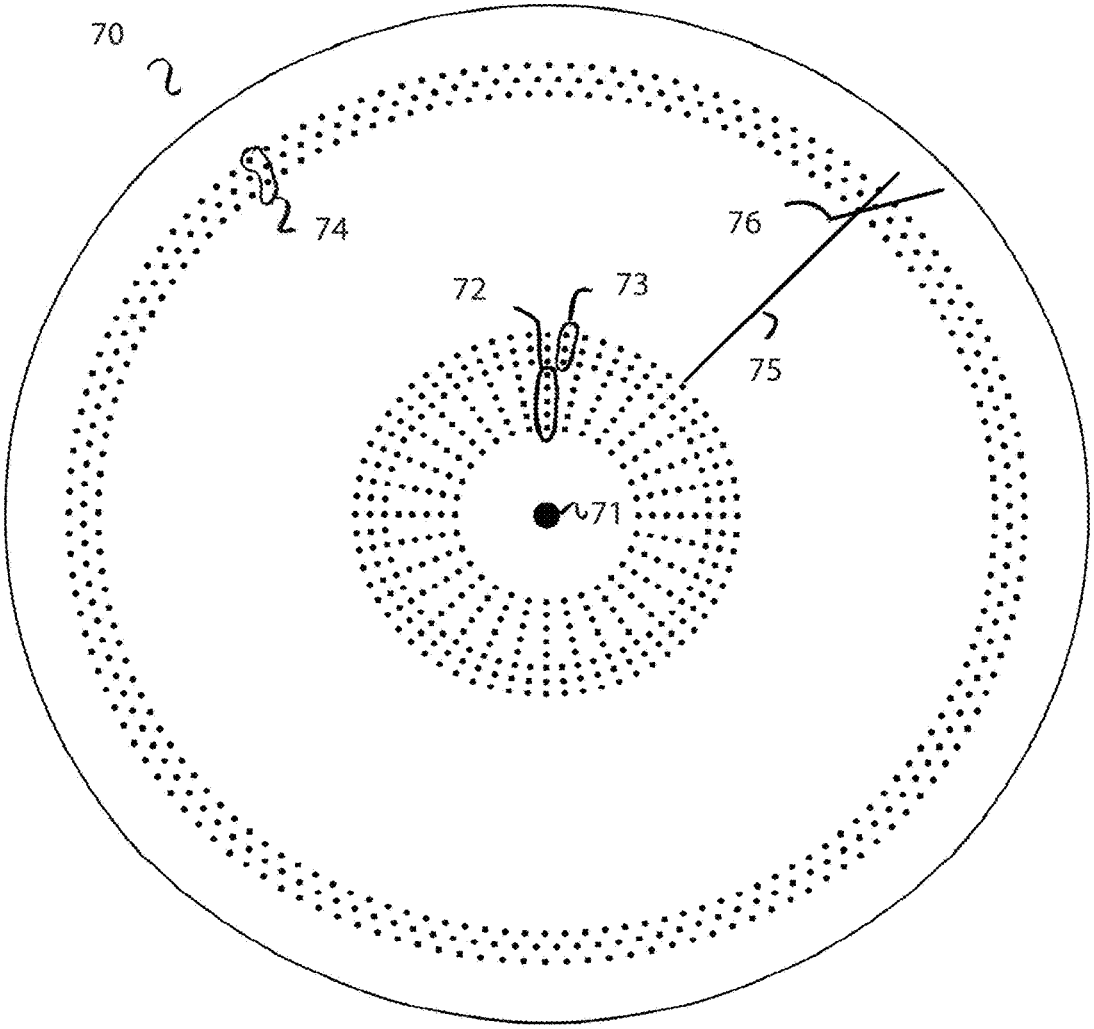
FIG. 7 is an illustration of the apertures on a 20 inch diameter cymbal.

The location of the apertures in a 20 inch cymbal 70 is illustrated in FIG. 7. The location of the apertures in this cymbal is specified in the following Table 7:

TABLE 7

| Pattern on a 508.00 mm diameter cymbal | | | |
|---|---|---|---|
| | Number of Holes | Radius | Offset |
| 1 | 32 | 45.00 mm | 0.00° |
| 2 | 32 | 52.00 mm | 0.00° |
| 3 | 32 | 59.00 mm | 0.00° |
| 4 | 32 | 66.00 mm | 0.00° |
| 5 | 32 | 73.00 mm | 0.00° |
| 6 | 64 | 80.00 mm | 0.00° |
| 7 | 64 | 87.00 mm | 0.00° |
| 8 | 64 | 94.00 mm | 0.00° |
| 9 | 140 | 210.00 mm | 0.00° |
| 10 | 140 | 217.00 mm | 40.00° |
| 11 | 140 | 224.00 mm | 0.00° |

From Table 7 and FIG. 7, it may be seen that cymbal 70 has eleven rings of apertures (recall from above the apertures have a diameter of ⅛" or 3.175 mm), the first 5 rings (labelled 72) having 32 evenly spaced apertures, the next three rings (labelled 73) having 64 evenly spaced apertures, and the last three rings (labelled 74) having 140 evenly spaced apertures, the eleven rings are located 45, 52, 59, 66, 73, 80, 87, 94, 210, 217 and 224 mm from the center of mounting hole 71, and the tenth ring is offset 40° from the other rings. In one embodiment, the bell has a diameter of 5" or 12.7 cm, and the cymbal is approximately 0.053" thick in the bell and approximately 0.040 to 0.045" thick in the bow.

As may be seen in FIG. 7, offset refers to the angle formed by the intersection of a line 75 extending radially from the center of the mounting hole through row of holes and a line 76 drawn from an aperture in the offset ring and an aperture in the next closest non-offset ring.

Figure 8:
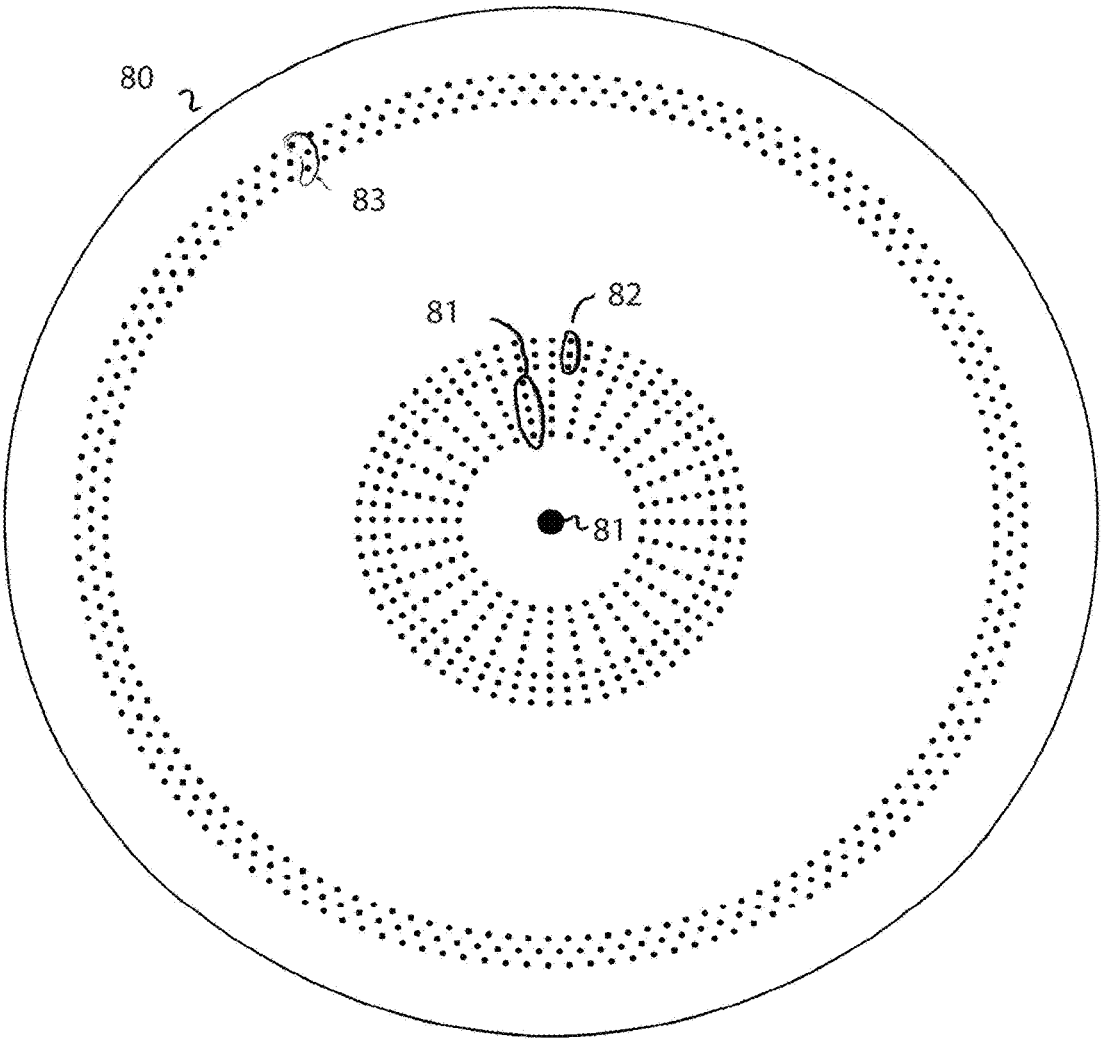
FIG. 8 is an illustration of the apertures on a 21 inch diameter cymbal.

The location of the apertures in a 21 inch cymbal 80 is illustrated in FIG. 8. The location of the apertures in this cymbal is specified in the following Table 8:

TABLE 8

| Pattern on a 533.00 mm diameter cymbal | | | |
|---|---|---|---|
| | Number of Holes | Radius | Offset |
| 1 | 32 | 45.00 mm | 0.00° |
| 2 | 32 | 52.00 mm | 0.00° |
| 3 | 32 | 59.00 mm | 0.00° |

TABLE 8-continued

| Pattern on a 533.00 mm diameter cymbal | | | |
|---|---|---|---|
| | Number of Holes | Radius | Offset |
| 4 | 32 | 66.00 mm | 0.00° |
| 5 | 32 | 73.00 mm | 0.00° |
| 6 | 64 | 80.00 mm | 0.00° |
| 7 | 64 | 87.00 mm | 0.00° |
| 8 | 64 | 94.00 mm | 0.00° |
| 9 | 140 | 217.00 mm | 0.00° |
| 10 | 140 | 224.00 mm | 40.00° |
| 11 | 140 | 231.00 mm | 0.00° |

From Table 8 and FIG. 8, it may be seen that cymbal 80 has eleven rings of apertures (recall from above the apertures have a diameter of ⅛" or 3.175 mm), the first 5 rings (labelled 81) having 32 evenly spaced apertures, the next three rings (labelled 82) having 64 evenly spaced apertures, and the last three rings (labelled 83) having 140 evenly spaced apertures, the eleven rings are located 45, 52, 59, 66, 73, 80, 87, 94, 217, 224 and 231 mm from the center of mounting hole 81, and the tenth ring is offset 40° from the other rings. In one embodiment, the bell has a diameter of 5" or 12.7 cm, and the cymbal is approximately 0.053" thick in the bell and approximately 0.043 to 0.048" thick in the bow.

Figure 9:
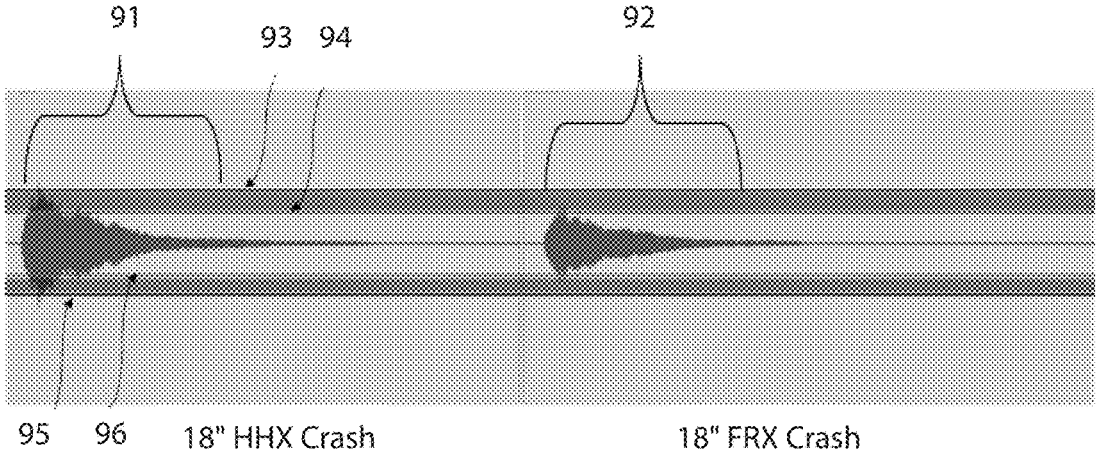
FIG. 9 shows waveforms for an inventive 18" crash cymbal compared to a typical 18" crash cymbal.
Figure 10:
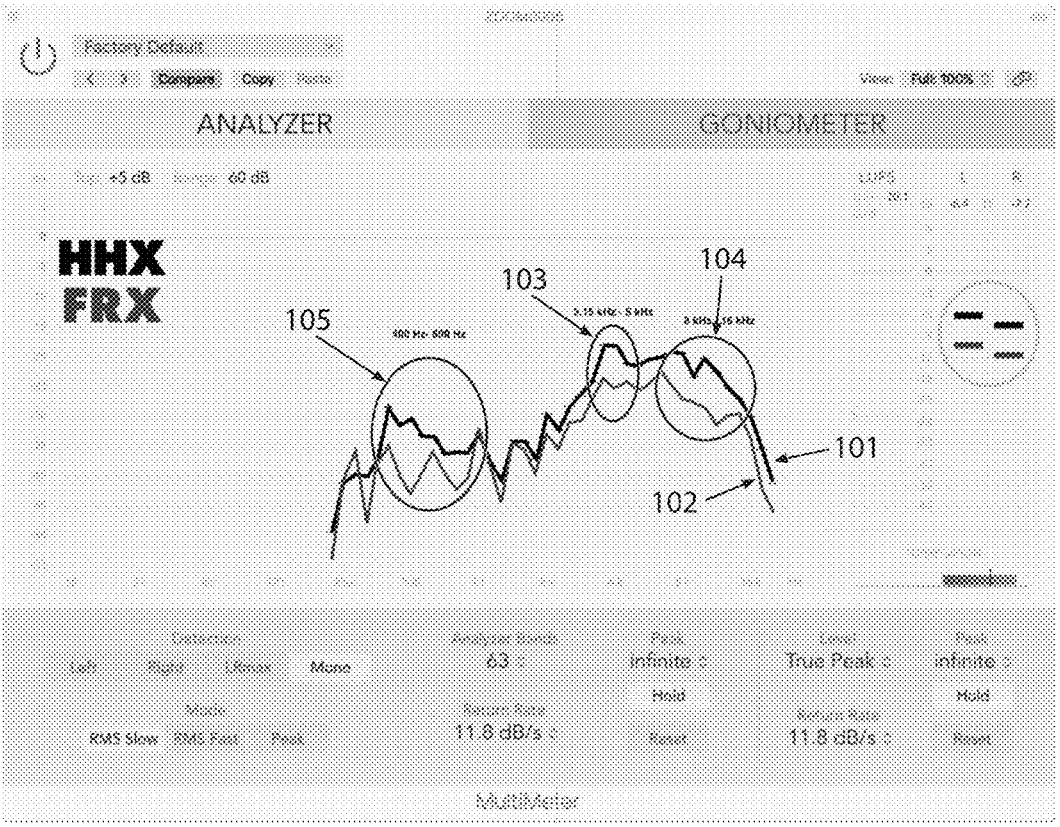
FIG. 10 shows frequency curves for an inventive 18" crash cymbal compared to a typical 18" crash cymbal.

Testing results using a typical 18" crash cymbal (a Sabian™ HHX™ crash) and a an 18" inventive crash cymbal (labelled FRX™ crash) are shown in FIGS. 9 and 10. Turning to FIG. 9, an 18" crash cymbal produces a waveform 91, and an 18" inventive crash cymbal produces a waveform 92. Lines 93 and 94, and lines 95 and 96, indicate a 4 dB reduction in frequency. As may be seen in FIG. 9, the 4 dB reduction occurs primarily in the high frequencies. There is also a reduction in the midrange frequencies, though it is hard to see in FIG. 9. Turning to FIG. 10, the frequency reduction curve resulting from the use of the inventive cymbal is shown. Frequency curve 101 is the frequency curve from the normal 18" crash cymbal, and frequency curve 102 is the frequency curve from an inventive 18" crash cymbal. It may be seen that in the high frequencies, frequency curve 102 is lower than frequency curve 101. In particular, there is a significant decrease in the 3.15 kHz to 5 kHz range, labelled 103, and in the 8 kHz to 16 kHz range, labelled 104. There is also a decrease in the 400 Hz to 800 Hz range, labelled 105. Most of the rest of the frequency curves 101 and 102 are similar. Overall, the frequency curves show a significant reduction across the high frequencies (3.15 kHz to 16 kHz) and a reduction in the midrange frequencies (400 Hz to 800 Hz) with a relatively small impact on the other frequencies. The reduction in high frequencies (3.15 kHz to 16 kHz) is often desirable to reduce the projection or presence of the cymbal, while the reduction in midrange frequencies (400 Hz to 800 Hz) may be desirable to avoid vocals.

A person skilled in the art will recognize that the various dimensions and measurements given above can vary within the manufacturing tolerances typical in the cymbal manufacturing industry.

In a specific embodiment, the cymbals in FIGS. 3 through 8 are made from a Sabian™ B20 bronze alloy, although it is believed that the patterns of apertures will provide similar results for a wide range of materials. It is also believed that the invention will work with cymbals with a range of thicknesses typically seen in cymbals in the industry.

The desired frequency reduction is achieved by this design with or without the presence of a coating on the cymbal.

The apertures or holes are described above as holes of ⅛" or 3.175 mm diameter. It is believed that the apertures may be other shapes than holes may be used, as long as the apertures are of approximately a similar area (on the surface of the cymbal), while maintaining the desired frequency reduction. It is also believed that slightly smaller or larger apertures or holes may be used while maintaining the desired frequency reduction. It is also believed that small variations in the location of the apertures may be used while maintaining the desired frequency reduction.

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A circular cymbal with a central mounting hole surrounded by a bell area surrounded by a bow area, and a plurality of approximately 3.175 mm diameter apertures pierced through the cymbal, where the plurality of apertures consists of at least one ring of evenly spaced apertures, where the closest ring located to the central mounting hole is 45 mm from the central mounting hole, and each ring is at least 7 mm apart in the bell area and less than 15 mm apart in the bow area nearest the bell area.

2. The circular cymbal of claim 1 where the cymbal has an approximately 355 mm diameter and a central mounting hole and a plurality of 3.175 mm diameter apertures pierced through the cymbal, where the plurality of apertures is a ring of evenly spaced 32 apertures located 45 mm from the mounting hole.

3. The circular cymbal of claim 1 where the cymbal has an approximately 355 mm diameter and a central mounting hole and a plurality of 3.175 mm diameter apertures pierced through the cymbal, where the plurality of apertures consists of seven rings of evenly spaced apertures, where five rings have 32 apertures in each ring and are located 45 mm, 52 mm, 59 mm, 66 mm, and 73 mm from the mounting hole, and two rings have 64 apertures in each ring and are located 80 mm and 87 mm from the mounting hole.

4. The circular cymbal of claim 3 where none of the rings of apertures are offset.

5. The circular cymbal of claim 1 where the cymbal has an approximately 406 mm diameter and a central mounting hole and a plurality of 3.175 mm diameter apertures pierced through the cymbal, where the plurality of apertures consists of seven rings of evenly spaced apertures, where five rings have 32 apertures in each ring and are located 45 mm, 52 mm, 59 mm, 66 mm, and 73 mm from the mounting hole, and two rings have 64 apertures in each ring and are located 80 mm and 87 mm from the mounting hole.

6. The circular cymbal of claim 5 where none of the rings of apertures are offset.

7. The circular cymbal of claim 1 where the cymbal has an approximately 432 mm diameter and a central mounting hole and a plurality of 3.175 mm diameter apertures pierced through the cymbal, where the plurality of apertures consists of eight rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole.

8. The circular cymbal of claim 7 where none of the rings of apertures are offset.

9. The circular cymbal of claim 1 where the cymbal has an approximately 457 mm diameter and a central mounting hole and a plurality of 3.175 mm diameter apertures pierced through the cymbal, where the plurality of apertures consists of eight rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole.

10. The circular cymbal of claim 9 where none of the rings of apertures are offset.

11. The circular cymbal of claim 1 where the cymbal has an approximately 482.6 mm diameter and a central mounting hole and a plurality of 3.175 mm diameter apertures pierced through the cymbal, where the plurality of apertures consists of eight rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole.

12. The circular cymbal of claim 11 where none of the rings of apertures are offset.

13. The circular cymbal of claim 1 where the cymbal has an approximately 508 mm diameter and a central mounting hole and a plurality of 3.175 mm diameter apertures pierced through the cymbal, where the plurality of apertures consists of eleven rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole, three rings have 140 apertures in each ring and are located 210 mm, 217 mm and 224 mm from the mounting hole, and the ring located 217 mm from the mounting hole is offset by 40 degrees from the other rings.

14. The circular cymbal of claim 1 where the cymbal has an approximately 533 mm diameter and a central mounting hole and a plurality of 3.175 mm diameter apertures pierced through the cymbal, where the plurality of apertures consists of eleven rings of evenly spaced apertures, where five rings have 32 apertures in each ring and are located 45 mm, 52 mm, 59 mm, 66 mm, and 73 mm from the mounting hole, and three rings have 64 apertures in each ring and are located 80 mm, 87 mm and 94 mm from the mounting hole, three rings have 140 apertures in each ring and are located 217 mm, 224 mm and 231 mm from the mounting hole, and the ring located 224 mm from the mounting hole is offset by 40 degrees from the other rings.

* * * * *